US005909913A

United States Patent [19]

Fitz, Jr. et al.

[11] Patent Number: 5,909,913

[45] **Date of Patent: *Jun. 8, 1999**

[54] SHUT HEIGHT ADJUSTMENT MECHANISM FOR A TERMINAL APPLICATOR

[75] Inventors: Charles Edwin Fitz, Jr., Harrisburg; Marlin Robert Schollenberger, Myerstown; Kenneth Foster Folk, Harrisburg, all of Pa.

[73] Assignee: The Whitaker Corporation, Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 08/718,167

[22] Filed: Sep. 19, 1996

[51] Int. Cl.[6] ..... H01R 43/048; B21J 13/02

[52] U.S. Cl. ..... 29/753; 29/33 M; 29/863; 72/441; 72/446; 72/712; 100/257

[58] Field of Search ..... 29/33 M, 753, 29/863; 72/413, 441, 446, 482.3, 482.4, 712; 100/257

[56] References Cited

U.S. PATENT DOCUMENTS

| | | | |
|---|---|---|---|
| 3,091,276 | 5/1963 | Aquillon | 29/753 |
| 4,025,999 | 5/1977 | Wolyn et al. | 29/753 |
| 4,133,260 | 1/1979 | Gundal | 100/257 |
| 4,289,066 | 9/1981 | Proga | 100/257 X |
| 4,790,173 | 12/1988 | Boutcher, Jr. | 72/446 |
| 4,884,433 | 12/1989 | Kato | 72/446 |
| 5,046,241 | 9/1991 | Ricard | 29/863 |
| 5,095,599 | 3/1992 | Gloe et al. | 29/33 M |
| 5,228,326 | 7/1993 | Wasilko et al. | 72/446 |
| 5,275,032 | 1/1994 | Gloe et al. | 72/441 X |
| 5,289,713 | 3/1994 | Schafer | 72/446 |
| 5,323,634 | 6/1994 | Wolfe et al. | 72/446 |
| 5,337,589 | 8/1994 | Gloe et al. | 72/441 X |
| 5,481,796 | 1/1996 | Quinn | 29/753 |
| 5,483,739 | 1/1996 | Smith et al. | 29/753 |
| 5,491,994 | 2/1996 | Baldyga | 29/753 X |
| 5,517,749 | 5/1996 | Zuin | 29/753 |

FOREIGN PATENT DOCUMENTS

| | | | |
|---|---|---|---|
| 332815 | 9/1989 | European Pat. Off. | 29/753 |
| 597248A1 | 5/1994 | European Pat. Off. | H01R 43/048 |
| 9106138 | 5/1991 | WIPO | 29/753 |
| 9202059 | 2/1992 | WIPO | 29/753 |

OTHER PUBLICATIONS

International Search report, Applicant's file reference 16644 PCT, International Application No. PCT/US 97/16568, International filing date, Sep. 18, 1997.

English Translation of European Patent 0 597 248, dated May 18, 1994.

Schafer, Indexed rotary head for quick change tools, Aug. 28, 1996, pp. 1–2.

*Primary Examiner*—Peter Vo

*Attorney, Agent, or Firm*—Bradley N. Ditty

[57] ABSTRACT

A terminal applicator (10) is disclosed having a shut height adjustment mechanisms (68, 120) for controlling the shut height (102, 220) of both the terminal barrel crimping bar (26) and the insulation crimping bar (28). The mechanism includes upper and lower ramp members (126, 128) having opposed ramp surfaces (140), the lower ramp member being attached to the tooling ram (40) and the upper ramp member being rotationally coupled to the ram. By incrementally rotating the upper ramp member (128), the relative spacing between a press ram (222) and the tooling ram (40) can be adjusted, thereby changing the shut height (220) of the barrel crimping bar (26). A cam (72) is rotationally coupled to the tooling ram (40) at right angles to the axis (24) of the upper and lower ramp members (126, 128). The cam has a series of flat surfaces (98), each of which is a different distance from its center of rotation (79). Each flat surface is positionable in abutting engagement with the top surface (70) of the insulation tab crimping bar (28) for adjusting its shut height (102).

22 Claims, 8 Drawing Sheets

SHUT HEIGHT ADJUSTMENT MECHANISM FOR A TERMINAL APPLICATOR

The present invention relates to applicators for attaching terminals to wires and more particularly to a shut height adjusting mechanism for controlling the shut height of both the terminal barrel crimping bar and the insulation crimping bar.

BACKGROUND OF THE INVENTION

Terminal applicators which are used in conjunction with a press for attaching terminals to the ends of wires usually include a frame; a tooling ram slidingly coupled to the frame, crimping tooling attached to the tooling ram and the frame, a terminal feed mechanism, and a terminal guide track. An example of such a terminal applicator is disclosed in United U.S. Pat. No. 5,481,796 which issued Jan. 9, 1996 to Quinn. The applicator of the '796 patent is held in a press which has a press ram that is coupled to the applicator tooling ram and drives it through its working stroke to attach the terminal to the end of the wire. These applicators are designed, as much as possible, to be universal in that they will accommodate a wide range of terminals. Because there are many different types of terminals and a variety of different sizes, each having its own specific crimp height for a high quality crimped connection, the mechanism for controlling the crimp height must be able to adjust the applicator to a wide variety of shut height spacings. The shut height adjusting mechanism which controls crimp height, as shown in the '796 patent, includes a pair of rotatable discs that are interposed between the tooling ram and the press ram. The upper disc includes four pairs of raised portions that are positionable so that only two at a time are in engagement with the press ram. Each pair of raised portions are of a different height so that by positioning a desired pair in alignment with the press ram, the shut height of the terminal barrel crimping bar can be set to a desired value. Similarly, the lower disc included eight raised portions, any one of which can be positioned in engagement with the top of the insulation tab crimping bar. Each of these raised portions are of a different height so that by positioning a desired one in alignment with the top of the insulation tab crimping bar, the shut height of the crimping bar can be set to a desired value. However, since only four different barrel shut heights and eight different insulation tab shut heights can be accommodated with a particular pair of discs, sets of discs having raised portions of different height must be provided. These disc sets are expensive and require that the applicator be taken out of service while the discs are changed. To increase the adjusting capacity of the upper disc a single disc was developed having removable buttons of selected thicknesses instead of the raised portions. Such a structure is disclosed in U.S. Pat. No. 5,323,634 which issued Jun. 28, 1994 to Wolfe, et al By changing only the buttons the shut height of the barrel crimping bar can be changed to any desired value. However, this still required that a large number of different sized buttons be maintained on hand. Further, the insulation tab crimping bar was still limited to the eight different raised portions for its shut height adjustment.

What is needed is an adjusting mechanism that will permit a large number of different shut height spacings for both the barrel crimping bar and the insulation tab crimping bar without the need to change parts or to take the applicator out of service while making the adjustment.

SUMMARY OF THE INVENTION

A terminal applicator is provided for attaching a terminal to a wire. The applicator has a base and a tooling ram coupled to the base arranged to undergo reciprocating motion along a tooling ram axis in a first direction toward the base and in a second direction away from the base. The tooling ram is coupled to and driven by a press ram wherein the press ram and the tooling ram are in a first spaced relationship during movement in the first direction. The applicator includes lower tooling attached to the base, a terminal barrel crimping bar coupled to the tooling ram, and an insulation tab crimping bar coupled to the tooling ram. The insulation tab crimping bar is in a second spaced relationship to the terminal barrel crimping bar during movement in the first direction The first spaced relationship defines a first shut height between the terminal barrel crimping bar and the lower tooling and the second spaced relationship defines a second shut height between the insulation tab crimping bar and the lower tooling. A shut height adjusting mechanism is provided for selectively adjusting both the first shut height and the second shut height. The mechanism includes first and second adjusting members. The first adjusting member is rotationally coupled to the tooling ram and arranged for angular movement about a first axis wherein the angular movement changes the first spaced relationship. The second adjusting member is rotationally coupled to the tooling ram and arranged for angular movement about a second axis perpendicular to the first axis wherein the angular movement changes the second spaced relationship.

DESCRIPTION OF THE PREFERRED EMBODIMENT

Figure 1:
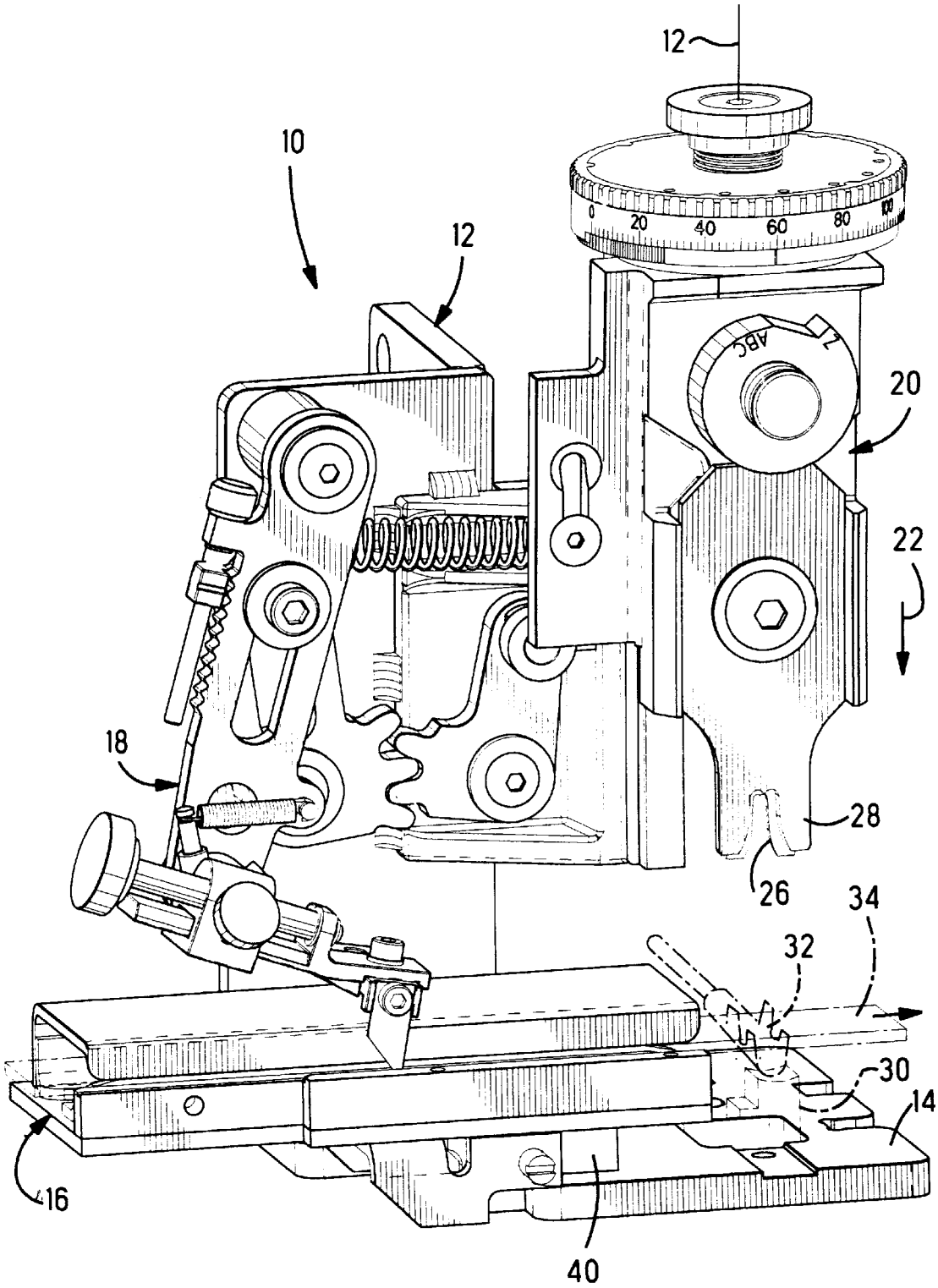
FIG. 1 is an isometric view of a terminal applicator incorporating the teachings of the present invention.

There is shown in FIG. 1 a terminal applicator 10 having a frame 12 including a base 14, a terminal feed track 16, a terminal feed mechanism 18, and a tooling ram assembly 20 coupled to the frame and arranged for reciprocating motion toward said base 14 in a first direction 22 along a ram axis 24 and away from said base in an opposite second direction. The tooling ram carries upper tooling consisting of a terminal barrel crimping bar 26 and an insulation tab crimping bar 28 that cooperate with lower tooling 30 attached to the base 14, shown in phantom lines, for attaching a terminal 32 that is fed along a terminal feed path 34 by the feed mechanism 18.

Figure 2:
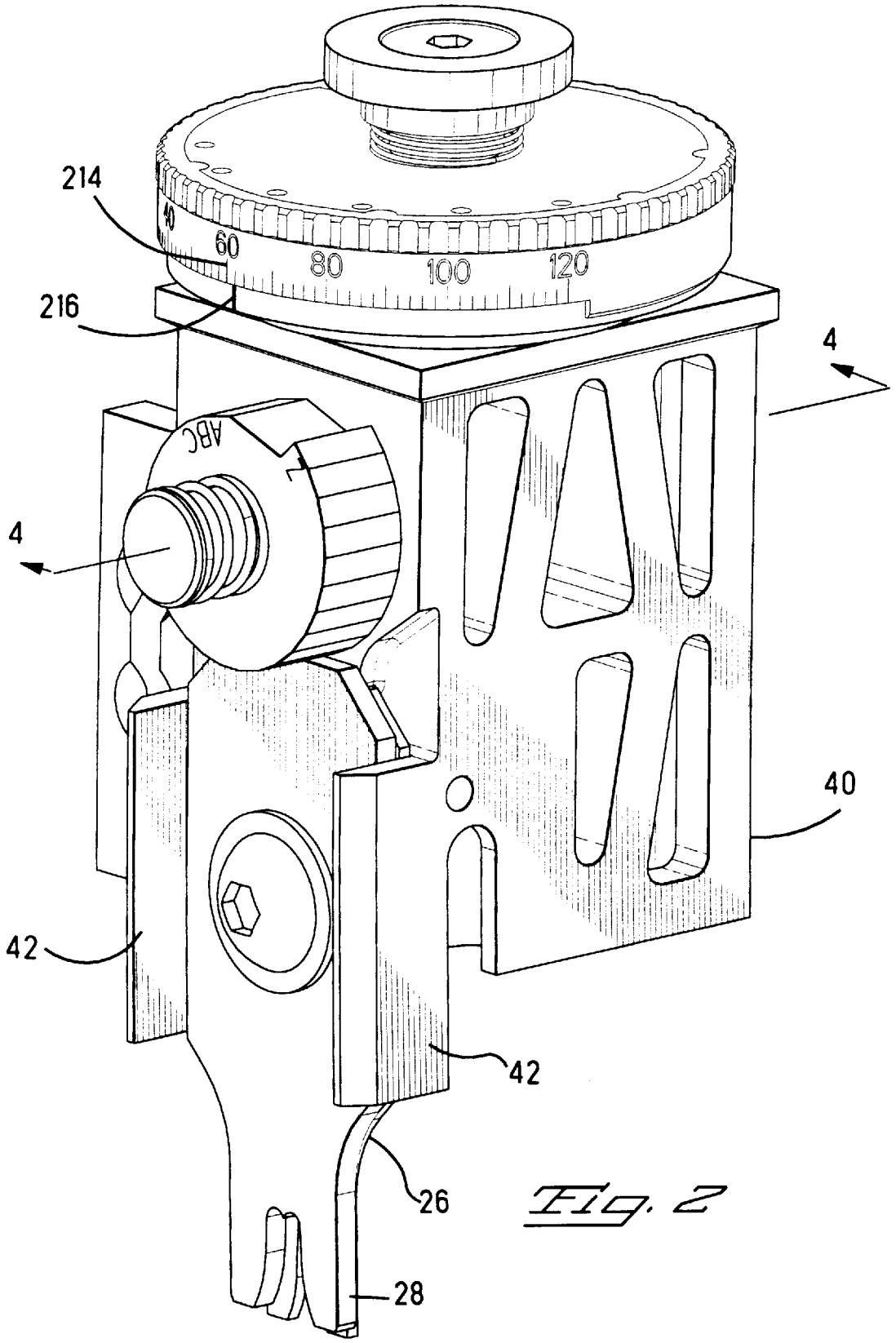
FIG. 2 is an isometric view of the tooling ram assembly shown in FIG. 1.
Figure 3:
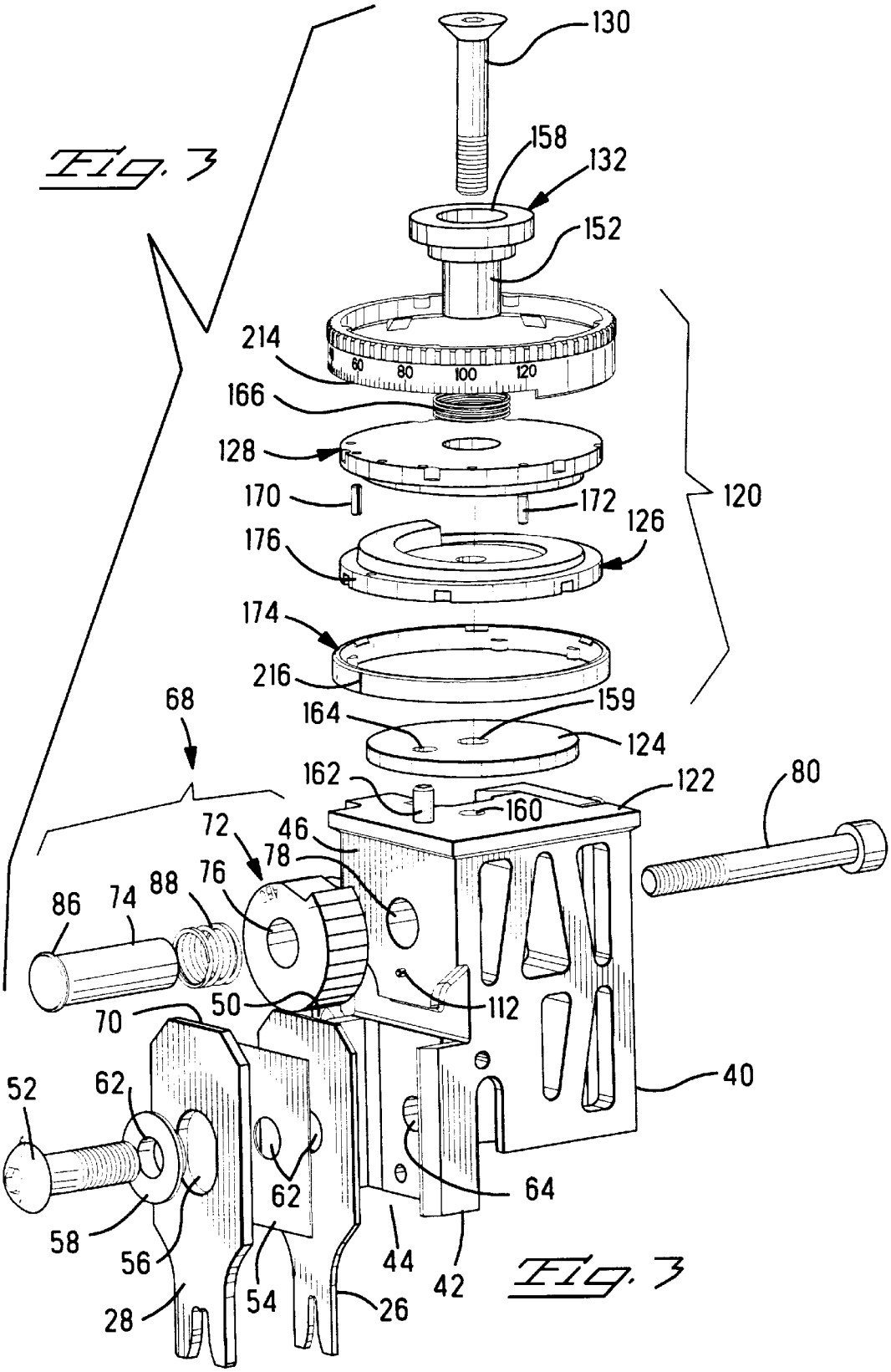
FIG. 3 is an exploded parts view of the tooling ram assembly.
Figure 4:
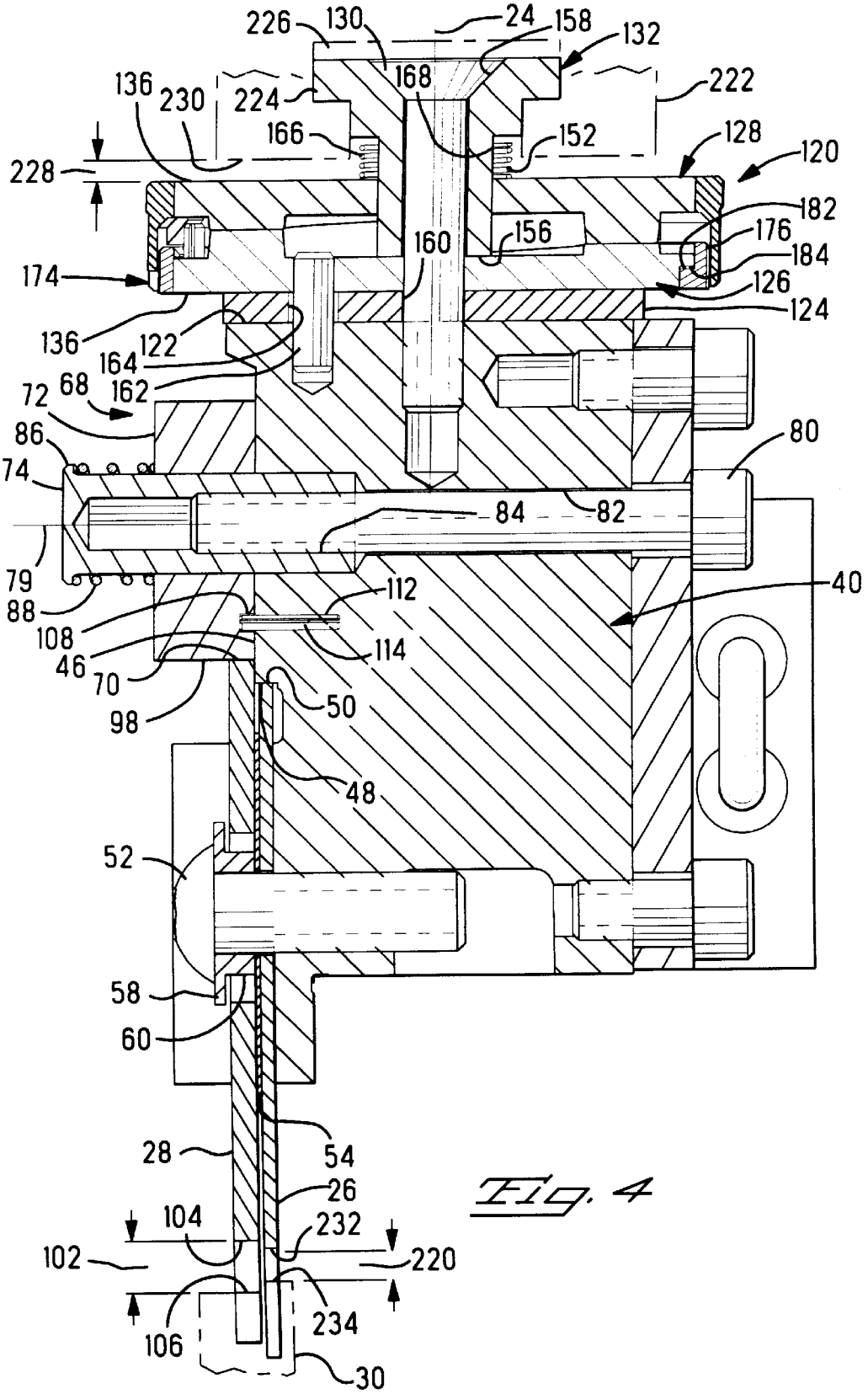
FIG. 4 is a cross-sectional view taken along the lines 4—4 in FIG. 2.

The tooling ram assembly 20 as best seen in FIGS. 2, 3, and 4, includes a ram 40 having a pair of opposed flanges 42 that form a recess 44 for receiving and aligning the crimping bars 26 and 28. The tooling ram 40 has a front surface 46 that projects outwardly to form a shoulder 48, as best seen in FIG. 4, against which the top 50 of the terminal barrel crimping bar 26 abuts The two crimping bars 26 and 28 are held within the recess 44 by means of a screw 52. A spacer plate 54 is disposed between the two crimping bars 26 and 28 to provide relative positioning with respect to the axis of the terminal 32. The insulation tab crimping bar 28 includes an elongated hole 56 that is sized to receive a shoulder washer 58, as shown in FIG. 4, having a reduced diameter 60 that closely but slidingly engages the elongated hole. The screw 52 extends through clearance holes 62 in the shoulder washer 58, spacer plate 54, and terminal barrel crimping bar 26, and into tight engagement with a threaded hole 64 in the tooling ram 40. The shoulder washer 58 is forced by the screw 52 against the spacer plate 54 thereby holding the spacer plate and the terminal barrel crimping bar tightly against the face of the tooling ram 40. The reduced diameter 60, however, is slightly longer than the thickness of the insulation tab crimping bar 28 thereby allowing the crimping bar to move vertically, as viewed in FIG. 4, within the limits of the elongated hole 56. In some cases additional tooling may be included such as a shear depressor and related spacer.

Figure 18:
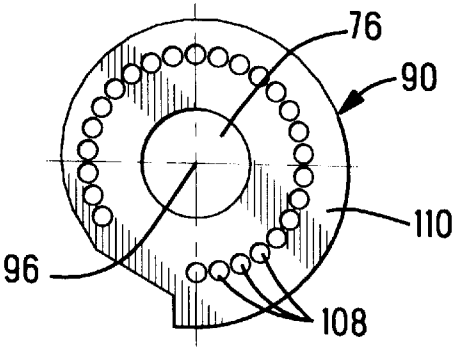
FIGS. 16, 17, and 18 are front, side, and back views, respectively, of the cam shown in FIG. 3.
Figure 17:
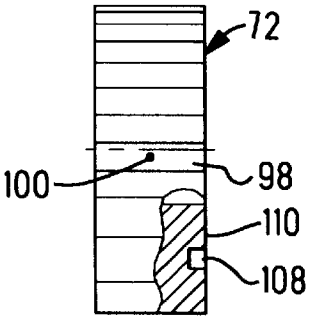
Figure 16:
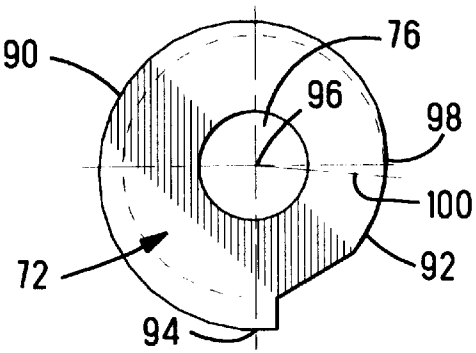

A shut height adjusting mechanism 68 is coupled to the front surface 46 of the tooling ram 40 as best seen in FIGS. 3 and 4. The insulation tab crimping bar 28 has a top surface 70 that abuts a somewhat spiral-shaped cam 72 that is rotationally coupled to the front surface 46 of the tooling ram 40 by means of a pin 74. The pin 74 extends through a close fitting hole 76 in the cam 72 and to the bottom of a close fitting hole 78 in the tooling ram 40 so that its axis 79 is perpendicular to the tooling ram axis 24. A screw 80 extends through a clearance hole 82 in the tooling ram 40 and into a threaded hole 84 in the pin 74 to pull the end of the pin tightly against the bottom of the hole 78. The pin 74 includes an enlarged head 86 thereby holding the cam 72 captive on the pin. A compression spring 88 is disposed around the pin 74 between the enlarged head 86 and the cam 72 to urge the cam against the front surface 46. As best seen in FIGS. 16, 17, and 18, the cam 72 includes an outer peripheral surface 90 that is somewhat spiral-shaped in that from a position 92, moving counterclockwise to a position 94, as shown in FIG. 16, the surface 90 incrementally diverges in steps away from the center 96. Each incremental step is a flat surface, indicated by way of example as 98 in FIGS. 16 and 17, which is perpendicular to a radial 100 extending from the center of the flat surface to the center 96. Therefore, the outer peripheral surface 90 of the cam 72 is a series of contiguous flat surfaces 98, each one being a different distance from the center 96 than its neighboring or adjacent flat surface. As can be seen in FIG. 4 the top 70 of the insulation tab crimping bar 28 is in abutting engagement with a flat surface 98, which limits upward movement of the crimping bar thereby determining its shut height 102, The shut height 102 is the distance between the forming portion 104 of the crimping bar 28 and the anvil 106 of the lower tooling 30 when the tooling ram 40 is in its full down position. This distance can be selectively changed by simply rotating the cam 72 so that a desired flat surface 98 is in abutting engagement with the top surface 70, the insulation tab crimping bar 28 being free to slide vertically within the limits of the elongated hole 56. As best seen in FIGS. 17 and 18 the cam includes a series of holes 108 formed in its back face 110. The series of holes 108 are on a common bolt circle and are angularly spaced similar to the angular spacing of the series of flat surfaces 98, so that each flat surface has a respective hole 108 associated therewith. A pin 112 extends from an interference fit hole 114 in the tooling ram 40, past the front surface 46 and loosely into one of the holes 108. This aligns the flat surface 98 associated with the hole 108 so that it is parallel to the top surface 70 of the insulation tab crimping bar 28. By pulling the cam 72 toward the left, as viewed in FIG. 4, thereby compressing the spring 88, until the back face 110 clears the pin 112, the cam can then be rotated until any desired flat surface 98 is in facing alignment with the top surface 70. The cam 72 is then allowed to return into engagement with the front surface 46, the pin 112 entering the associated hole 108 which holds the cam in the selected position and prevents it from rotating.

Figure 7:
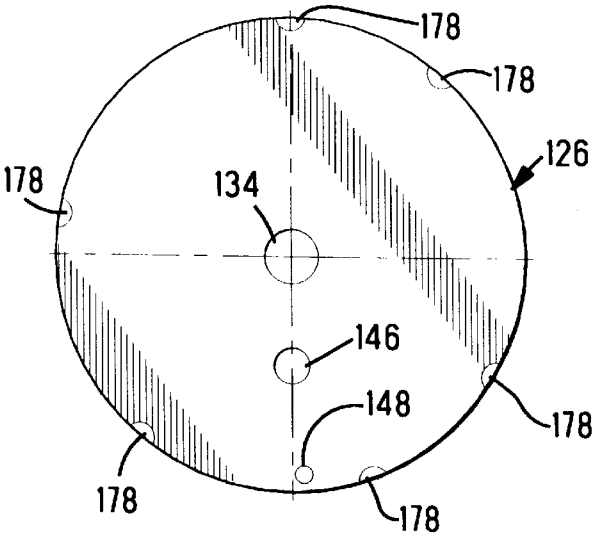
FIGS. 5, 6, and 7 are top, side, and bottom views, respectively, of the lower ramp member shown in FIG. 3.
Figure 6:
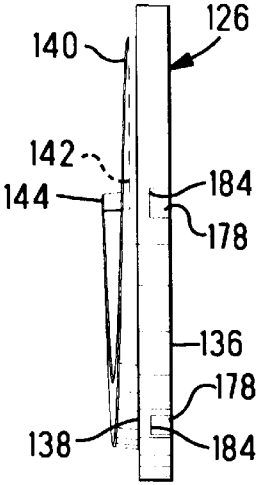
Figure 5:
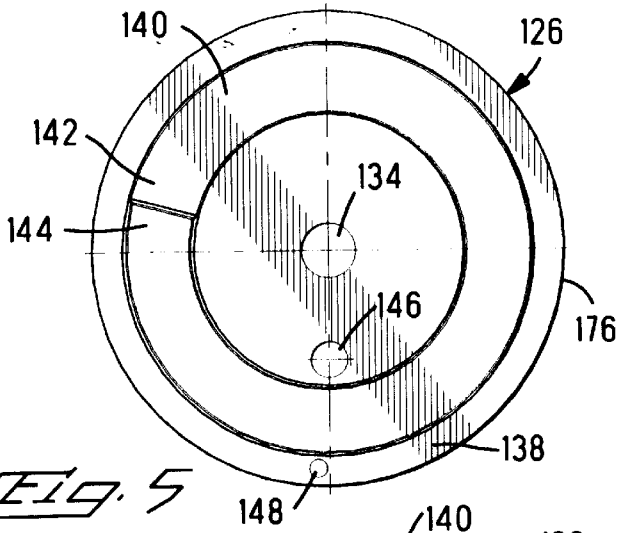
Figure 8:
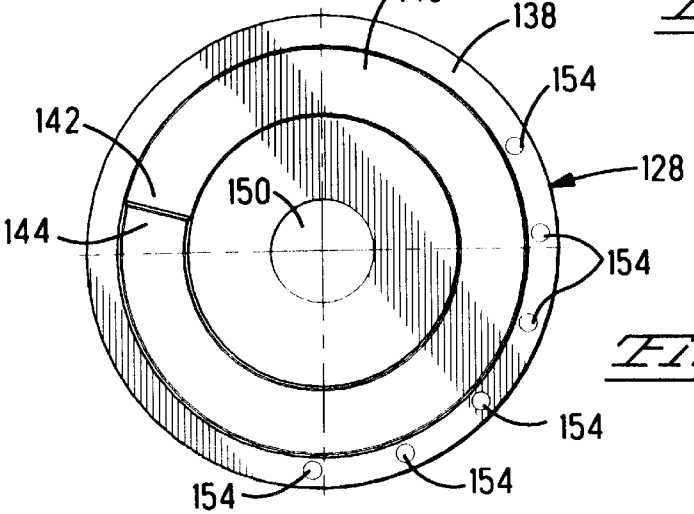
FIG. 8 is a bottom view of the upper ramp member shown in FIG. 3.
Figure 19:
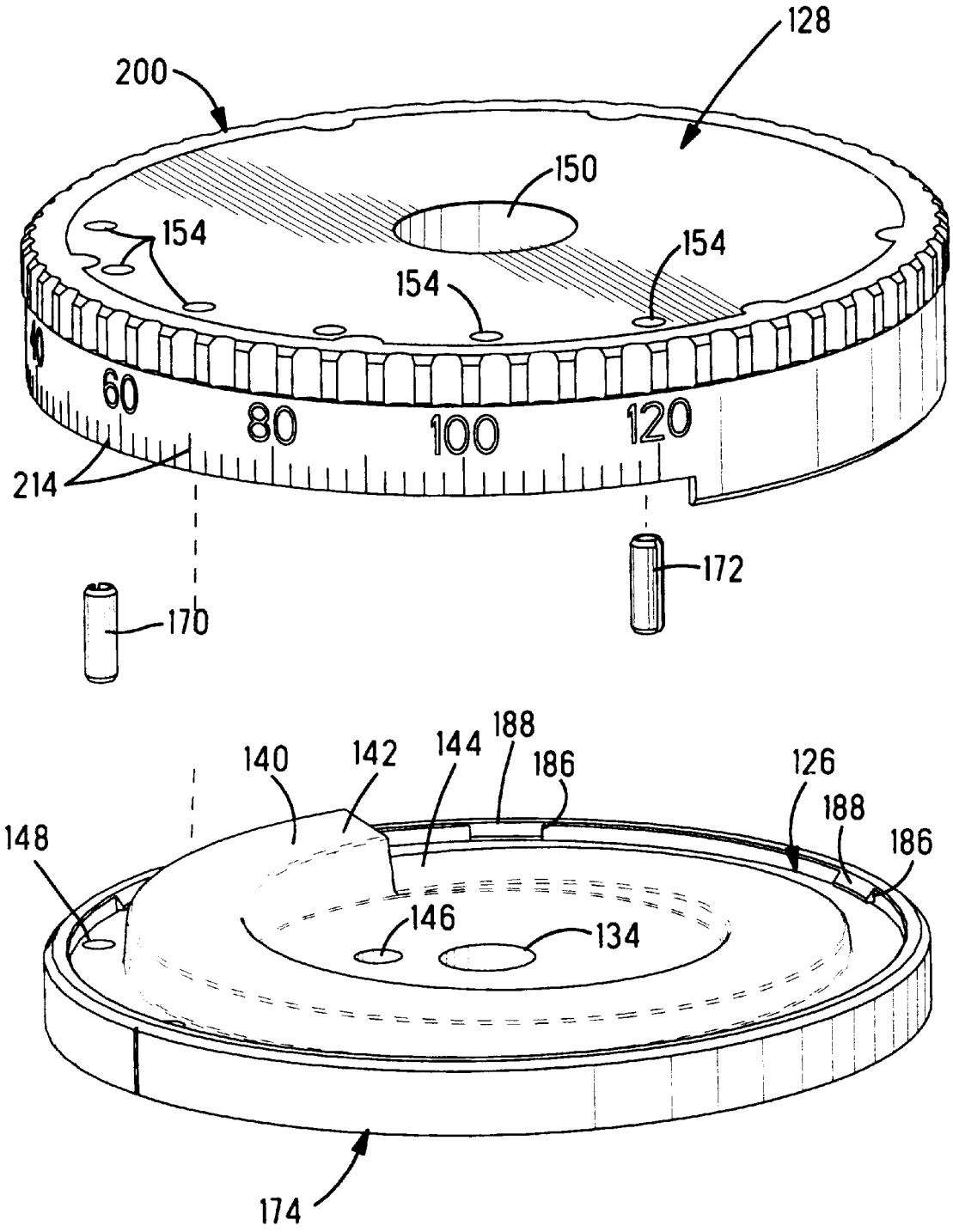
FIG. 19 is an isometric view of the upper and lower ramp members with their respective rings showing adjustment limiting stop pins.

A shut height adjusting mechanism 120 is coupled to the top surface 122 of the tooling ram 40 as best seen in FIGS. 3 and 4 The mechanism 120 includes a spacer disc 124, and lower and upper ramp members 126 and 128 which are secured to the tooling ram by means of a screw 130 and a ram post 132, as will be described below. As best seen in FIGS. 5, 6, and 7, the lower ramp member 126 is disc-shaped having a central concentric hole 134 that is a close fit clearance hole for the screw 130. The lower ramp member 126 has first and second parallel major surfaces 136 and 138. A ramp surface 140 rises smoothly and continuously from the surface 138, beginning at a point 142 where it is close to the surface 138 and rotating clockwise, as viewed in FIG. 5, to a point 144 where it is furthest from the surface 138. Two pin holes 146 and 148 are formed through the lower ramp member, as shown in FIGS. 5 and 7, for purposes that will be explained. The upper ramp member 128 is similar to the lower ramp member 126 having like features identified with like numbers. Instead of the central hole 134, the upper ramp member has a central hole 150 that is a slip fit with a reduced diameter 152 of the ram post 132 so that it is free to rotate on the ram post. Additionally, in place of the single pin hole 148 the upper ramp member 128 has several pin holes 154 that are formed through the disc similar to the pin hole 148 on a common bolt circle therewith, and that are spaced apart as shown in FIG. 8. In all other respects the lower and upper ramp members are similar. As best seen in FIGS. 3 and 4, the lower ramp member 126 and the spacer disc 124 are stacked on the top surface 122 and secured there by the end 156 of the ram post 132 which is held tightly against the lower ramp member by the screw 130. The screw 130 extends through a countersunk hole 158 formed axially through the ram post 132, through the hole 134 in the lower ramp member, through a clearance hole 159 in the spacer disc, and into a threaded hole 160 formed in the tooling ram 40. A pin 162 is pressed into a hole in the tooling ram 40 and extend above the top surface 122, through a clearance hole 164 in the spacer disc 124, and into the pin hole 146 in the lower ramp member 126, as best seen in FIG. 4. This prevents rotation of the lower ramp member 126 with respect to the tooling ram 40. As can be seen in FIGS. 3 and 4, the lower and upper ramp members 126 and 128 are arranged so that their respective ramps 140 are opposed and in mutual engagement, with the lower ramp member fixed against rotation and the upper ramp member free to rotate about the ram axis 24. A compression spring 166 is disposed around the reduced diameter 152 of the ram post 132 between a shoulder 168 and the surface 136 of the upper ramp member 128. This keeps the upper and lower ramp members in engagement and allows sufficient room for axial movement of the upper ramp member during adjustment. As best seen in FIG. 19 in partially exploded form, a first stop pin 170 is pressed into the pin hole 148 in the lower ramp member 126 and a second stop pin 172 is removably in one of the holes 154 in the upper ramp member 128. The stop pin 172 is carried by the upper ramp member 128 when the upper ramp member is rotated about the axis 24. Since the two stop pins 170 and 172 are on a common bolt circle, they will abuttingly engage when the upper ramp member has been rotated sufficiently far, thereby limiting the amount of rotation. By placing the stop pin 172 in a selected hole 154, the amount of rotation of the upper ramp member 128 can be controlled.

Figure 10:
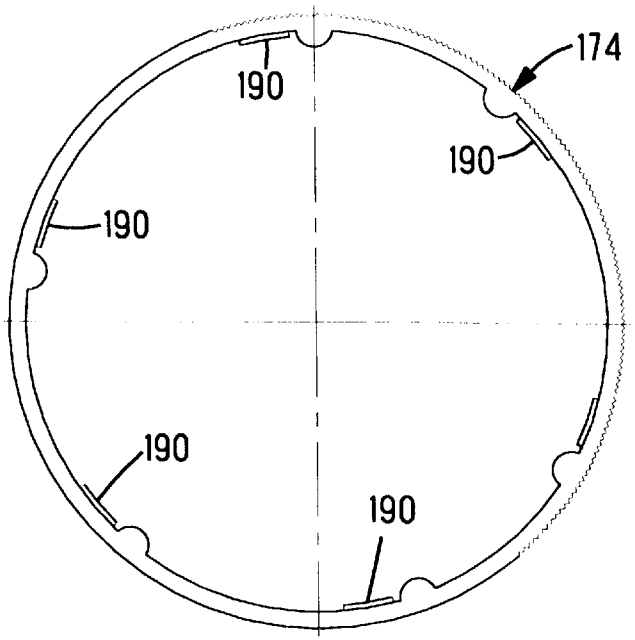
FIGS. 9 and 10 are bottom and top views, respectively, of the lower ring shown in FIG. 3.
Figure 11:
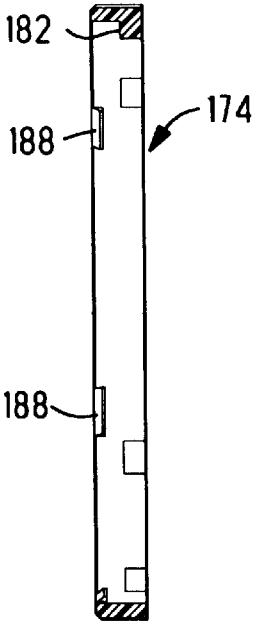
FIG. 11 is a cross-sectional view taken along the lines 11—11 in FIG. 9.
Figure 12:
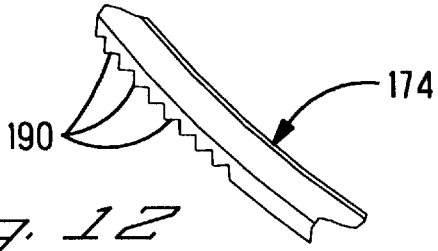
FIG. 12 is an enlarged view of a portion of the lower ring indicated by the arrows 12—12 shown in FIG. 9.
Figure 9:
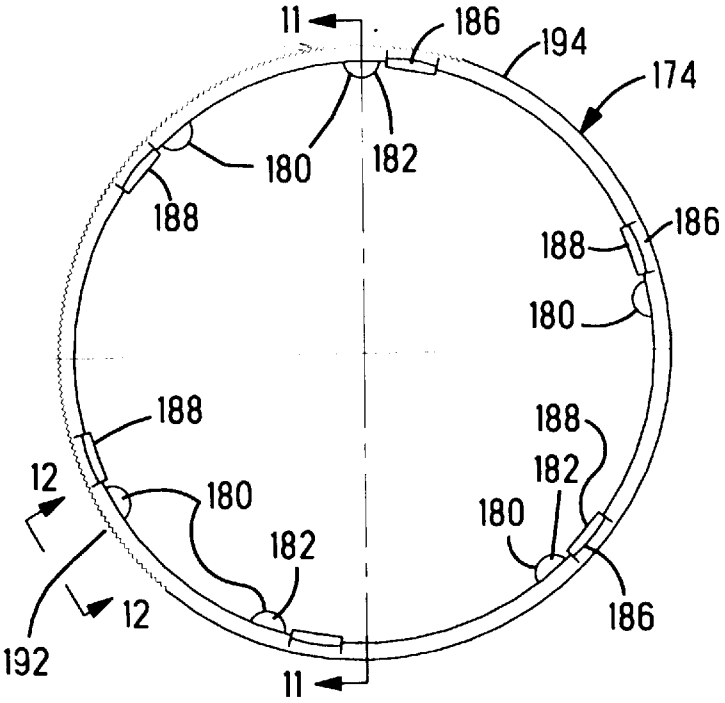

As best seen in FIGS. 3, 4, and 19, the lower ramp member 126 has a lower ring 174 that is in engagement with its outer peripheral surface 176. The surface 136 of the lower ramp member 126 includes several spaced pockets 178, as shown in FIG. 7, along its edge that receive projections 180 extending from the inside diameter of the ring 174. Each projection 180 has a shoulder 182 that engages the bottom 184, shown in FIG. 6, of the corresponding pocket 178. A series of cleats 186 are spaced along an edge of the ring opposite the edge having the projections 180. Each cleat 186 has a camming surface 188 shown in FIGS. 9 and 11 and a catch surface 190 shown in FIG. 10. When the lower ring 174 is assembled to the lower ramp member 126, it is advance from the position shown in FIG. 4, into engagement with the ramp member so that the camming surfaces 188 cam outwardly and around the outer surface 176 of the ramp member. The camming surfaces 188 then snap inwardly again, under the resilient urging of the ring when the catch surfaces 190 clear the outer surface 176 so that the surfaces 138 and 184 of the ramp member are trapped between the surfaces 182 and 190 of the ring. The projections 180 being in the pockets 178 prevent relative rotation of the ring and ramp member. Alternatively, the pockets 178 may be through slots or other structures and the lower ring 174 may have another feature to trap the lower ramp member and hold it captive to the lower ring. The outer diameter of the ring 174 includes a series of serrations or depressions 190, as best seen in FIG. 12, that extend about a portion of the periphery from the point 192 to the point 194, as shown in FIG. 9 The purpose of these serrations 190 will be explained below.

Figure 14:
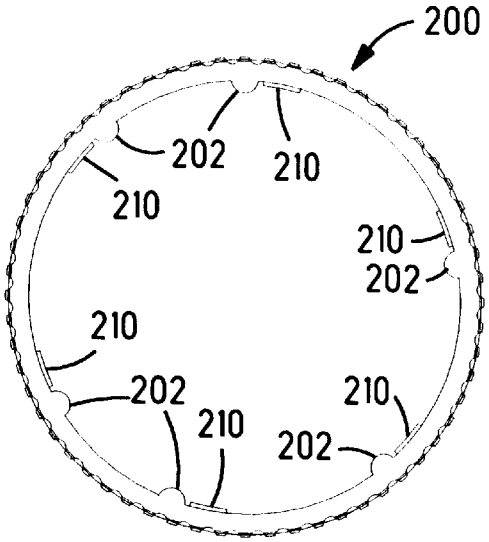
FIGS. 13 and 14 are bottom and top views, respectively, of the upper ring shown in FIG. 3.
Figure 15:
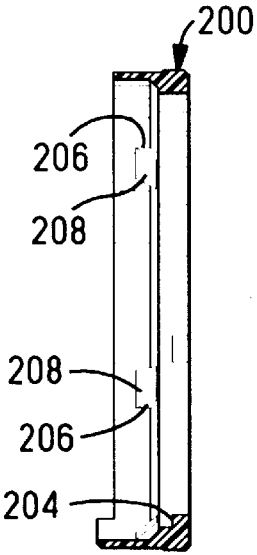
FIG. 15 is a cross-sectional view taken along the lines 15—15 in FIG. 13.
Figure 13:
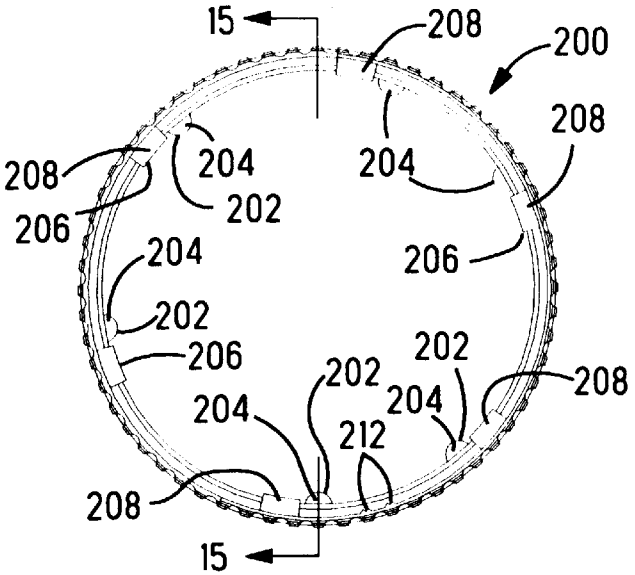

Similarly, as best seen in FIGS. 3, 4, and 19, the upper ramp member 128 has an upper ring 200 that is in engagement with its outer peripheral surface 176. As with the lower ramp member, the surface 136 of the upper ramp member 128 includes several spaced pockets 178 along its edge that receive projections 202 extending from the inside diameter of the ring 200. Each projection 202 has a shoulder 204 that engages the bottom 184, shown in FIG. 6, of the corresponding pocket 178. A series of cleats 206 are spaced along an edge of the ring opposite the edge having the projections 202. Each cleat 206 has a camming surface 208 shown in FIGS. 13 and 15 and a catch surface 210 shown in FIG. 14. When the upper ring 200 is assembled to the upper ramp member 128, it is advanced from the position shown in FIG. 4, into engagement with the ramp member so that the camming surfaces 208 cam outwardly and around the outer surface 176 of the upper ramp member. The camming surfaces 208 then snap inwardly again, under the resilient urging of the ring when the catch surfaces 210 clear the outer surface 176 so that the surfaces 138 and 184 of the ramp member are trapped between the surfaces 204 and 210 of the ring. The projections 202 being in the pockets 178 prevent relative rotation of the upper ring 200 and the upper ramp member 128. Alternatively, the pockets 178 may be through slots or other structures and the upper ring 200 may have another feature to trap the upper ramp member and hold it captive to the upper ring. The inner diameter of the ring 200 includes a series of projections 212, as best seen in FIG. 13, that are sized to be received in the serrations 190. The outer wall of the upper ring having these serrations is somewhat thin and resilient so that when the upper ring 200 is incrementally rotated, the projections 212 will cam out of the serrations 190 and then immediately snap back into the adjacent serrations 190, thereby functioning as a detent This permits the easy rotation of the upper ring 200 and upper ramp member 128 by simply applying a rotational force to the upper ring. When the rotational force is removed the projections 212 interferingly engage the serrations 190, thereby holding the upper ring and ramp member in their current position with respect to the lower ring and ramp member.

As shown in FIGS. 2, 3, and 19, the upper ring 200 includes indices 214 on its outer peripheral surface that can be aligned with a home mark 216, shown in FIG. 2 and 3, used for reference when adjusting the shut height 220, shown in FIG. 4, of the terminal barrel crimping bar 26. As best seen in FIG. 4, the tooling ram 40 is coupled to a press ram 222, shown in phantom lines, by means of the ram post 132. The ram post 132 includes an enlarged head 224 that rides in a T-slot 226 formed in the press ram. There may be a small amount of vertical play 228 between the press ram 222 and the upper ramp member 128 that is taken out during the downward stroke of the press ram as the upper crimping bars 26 and 28 engage the terminal 32. During this downward stroke the lower surface 230 of the press ram 222 is in abutting engagement with the surface 136 of the upper ramp member 128. The shut height 220 is the distance between the forming portion 232 of the barrel crimping bar 26 and the anvil 234 of the lower tooling 30 when the tooling ram 40 is in its full down position. This distance can be selectively changed by simply rotating the upper ramp member 128 with respect to the lower ramp member 126 so that the two opposing ram surfaces 140 cause the two opposite surfaces 136 of the upper and lower ram members to become closer together or further apart. This results in changing the spaced relationship of the tooling ram 40 to the press ram 222 by moving the entire tooling ram closer to or further away from the surface 230 of the press ram. As set forth above, when incrementally rotating the upper ring 200 and upper ramp member 128, the projections 212 will cam out of the serrations 190 and then immediately snap back into interfering engagement with the adjacent serrations 190, thereby holding the upper ring and ramp member in their new position with respect to the lower ring and ramp member When the shut height adjusting mechanism 120 is adjusted in this manner, both of the two crimping bars 26 and 28 are moved with respect to the lower tooling 30. This occurs because the two crimping bars 26 and 28 and the abutting surfaces 48 and 98 are all coupled to and carried by the tooling ram 40. Therefore, whenever the shut height 220 is adjusted, the relative spacing of the insulation tab crimping bar 28 with respect to the barrel crimping bar 26 may need to be changed by adjusting the shut height 102 of the insulation tab crimping bar 28 as set forth above.

When larger adjustments of the shut height 220 are required than can be accommodated by rotating the upper ramp member 128, the spacer plate 124 may be removed and replaced by another spacer plate of different thickness. A spacer plate of less thickness results in a range of increased shut heights and a spacer plate of more thickness results in a range of reduced shut heights. While the two ramp surfaces 140 of the upper and lower ramp members 128 and 126 provide an infinite number of settings as the upper ramp member is rotated, practically, there are only discrete spaced apart settings that are usable due to the discrete positioning effect of the projections 212 in engagement with the serrations 190. However, the serrations are of rather fine pitch, 1.250 degrees per depression in the present example. This results in the capability to fine adjust the shut height 220 in incremental amounts of plus or minus 0.0005 inch. The shut height 102 of the insulation tab crimping bar 28, on the other hand, is afforded a very wide range of adjustment by the cam 72 obviating the need for an additional gross adjusting means. This wide adjustment range is made possible because the cam 72 has a large number of flat surfaces 98 of different distances from the pin axis 79 that serve to alter the spaced relationship of the insulation tab crimping bar 28 with respect to the barrel crimping bar 26. In the present example the cam 72 rotate about the pin axis 79 perpendicular to the tooling ram axis 24 so that the flat surfaces 190 can squarely engage the top surface 70 of the insulation tab crimping bar 28.

An important advantage of the present invention is that a wide range of very fine adjustments can be made to the shut height of both the barrel crimping bar and the insulation tab crimping bar, many more and finer adjustments than are possible with the prior art mechanisms. Additionally, for most adjustment ranges, all adjustments can be made without taking the applicator out of service, removing the adjusting discs, and replacing them with discs of a different size, as is required by the prior art mechanisms. Further, since a large inventory of adjusting discs are no longer needed, the expense associated therewith is avoided

We claim:

1. In a terminal applicator for attaching a terminal to a wire, said applicator having a base, a tooling ram coupled to said base arranged to undergo reciprocating motion along a tooling ram axis in a first direction toward said base and in a second direction away from said base, said tooling ram being coupled to and driven by a press ram wherein said press ram and said tooling ram are in a first spaced relationship during said movement in said first direction, including lower tooling attached to said base, a terminal barrel crimping bar coupled to said tooling ram, and an insulation tab crimping bar coupled to said tooling ram in a second spaced relationship to said terminal barrel crimping bar during said movement in said first direction, wherein said first spaced relationship defines a first shut height between said terminal barrel crimping bar and said lower tooling and said second spaced relationship defines a second shut height between said insulation tab crimping bar and said lower tooling, a shut height adjusting mechanism for selectively adjusting both said first shut height and said second shut height comprising:

(1) a first adjusting member including first and second ramp members having opposing ramp faces in mating engagement, said first ramp member being attached to said tooling ram and stationary with respect thereto and said second ramp member being rotationally coupled to said tooling ram for selected rotation about a first axis so that said selected rotation changes said first spaced relationship; and (2) a second adjusting member rotationally coupled to said tooling ram and arranged for angular movement about a second axis perpendicular to said first axis wherein said angular movement changes said second spaced relationship.

2. The applicator according to claim 1 wherein said second adjusting member comprises a disc-shaped member having an axis that coincides with said second axis and an outer peripheral surface having a series of flat surfaces, each of which are selectably movable into abutting engagement with said insulation tab crimping bar for changing said second spaced relationship, wherein each said flat surface is a different distance from said axis than is its adjacent flat surface.

3. The applicator according to claim 2 wherein said disc-shaped member is supported by a first pin extending from said tooling ram, said disc-shaped member being slidable axially along the length of said first pin into engagement with said tooling ram and rotatable about the axis of said first pin only when spaced from said tooling ram.

4. The applicator according to claim 3 including a spring arranged to urge said disc-shaped member into said engagement with said tooling ram.

5. The applicator according to claim 4 wherein said disc-shaped member includes a series of indentations in a surface thereof that is opposed to said tooling ram and said applicator including a second pin extending from said tooling ram into one of said series of indentations when said disc-shaped member is in said engagement with said tooling ram, thereby preventing said rotation of said disc-shaped member.

6. The applicator according to claim 5 wherein each indentation of said series of indentations is related to a respective one flat surface of said series of flat surfaces so that each said indentation, when engaged with said second pin, will align its respective flat surface for said engagement with said insulation tab crimping bar.

7. In a terminal applicator for attaching a terminal to a wire, said applicator having a tooling ram coupled to and driven by a press ram wherein said press ram and said tooling ram are in a first spaced relationship, said applicator including a terminal barrel crimping bar coupled to said tooling ram and an insulation tab crimping bar coupled to said tooling ram in a second spaced relationship to said terminal barrel crimping bar, a shut height adjusting mechanism comprising:

(1) a first adjusting member including first and second ramp members having opposing ramp faces in mating engagement, said first ramp member being attached to said tooling ram and stationary with respect thereto and said second ramp member being rotationally coupled to said tooling ram for selected rotation about a first axis, wherein said selected rotation changes said first spaced relationship; and (2) a second adjusting member rotationally coupled to said tooling ram and arranged for angular movement about a second axis perpendicular to said first axis wherein said angular movement changes said second spaced relationship.

8. The applicator according to claim 7 wherein said first axis is parallel to said tooling ram axis.

9. The applicator according to 7 including locking means for releasibly holding said second ramp member stationary with respect to said first ramp member.

10. The applicator according to claim 9 wherein said first ramp member includes an outer diameter and said second ramp member includes an inner diameter in surrounding relationship with said outer diameter and wherein said locking means comprises a feature on said outer diameter in releasable interference with a feature on said outer diameter.

11. The applicator according to claim 10 wherein said feature on said outer diameter is a series of spaced depressions and said feature on said inner diameter is a series of projections that mate with some of said series of depressions.

12. The applicator according to claim 11 including a ring attached to said second ramp member, said ring having a wall surrounding said outer diameter wherein said inner diameter is an inside surface of said wall and said wall is resilient and biases said projections into locking engagement with said depressions so that upon rotation of said ring said projections cam out of said depression thereby permitting said selected rotation of said second ramp member.

13. The applicator according to claim 9 wherein said press ram is in engagement with a face of said second ramp member opposite said ramp face so that said press ram is in force transmitting relationship with said tooling ram through said opposing ramp faces, wherein upon rotation of said second ramp member in one direction said press ram and said tooling ram are moved further apart, and upon rotation of said second ramp member in an opposite direction said press ram and said tooling ram are moved closer together.

14. The applicator according to claim 13 including a replaceable spacer between said press ram and said tooling ram.

15. The applicator according to claim 9 including a first stop member associated with said first ramp member and a second stop member associated with said second ramp member arranged to mutually interfere to limit the amount of said rotation of said second ramp member.

16. The applicator according to claim 15 wherein said first stop member is a pin extending from a hole in said first ramp member and said second stop member is a pin extending from a hole in said second ramp member.

17. In a terminal applicator for attaching a terminal to a wire, said applicator having a tooling ram coupled to and driven by a press ram wherein said press ram and said tooling ram are in a first spaced relationship, said applicator including a terminal barrel crimping bar coupled to said tooling ram and an insulation tab crimping bar coupled to said tooling ram in a second spaced relationship to said terminal barrel crimping bar, a shut height adjusting mechanism comprising:

(1) a first adjusting member rotationally coupled to said tooling ram and arranged for angular movement about a first axis wherein said angular movement changes said first spaced relationship; and (2) a second adjusting member rotationally coupled to said tooling ram and arranged for angular movement about a second axis perpendicular to said first axis, comprising a disc-shaped member having an axis that coincides with said second axis and an outer peripheral surface having a series of flat surfaces, each of which are selectably movable into abutting engagement with said insulation tab crimping bar for changing said second spaced relationship, wherein each said flat surface is a different distance from said axis than is its adjacent flat surface.

18. The applicator according to claim 17 wherein said disc-shaped member is supported by a first pin extending from said tooling ram, said disc-shaped member being slidable axially along the length of said first pin into engagement with said tooling ram and rotatable about the axis of said first pin only when spaced from said tooling ram.

19. The applicator according to claim 18 including a spring arranged to urge said disc-shaped member into said engagement with said tooling ram.

20. The applicator according to claim 19 wherein said disc-shaped member includes a series of indentations in a surface thereof that is opposed to said tooling ram and said applicator including a second pin extending from said tooling ram into one of said series of indentations when said disc-shaped member is in said engagement with said tooling ram, thereby preventing said rotation of said disc-shaped member.

21. The applicator according to claim 20 wherein each indentation of said series of indentations is related to a respective one flat surface of said series of flat surfaces so that each said indentation, when engaged with said second pin, will align its respective flat surface for said engagement with said insulation tab crimping bar.

22. In a terminal applicator for attaching a terminal to a wire, said applicator having a tooling ram coupled to and driven by a press ram wherein said press ram and said tooling ram are in a first spaced relationship and undergo reciprocating motion along a tooling ram axis, said applicator including a terminal barrel crimping bar coupled to said tooling ram and an insulation tab crimping bar coupled to said tooling ram in a second spaced relationship to said terminal barrel crimping bar, a shut height adjusting mechanism comprising:

(1) a first adjusting member rotationally coupled to said tooling ram and arranged for angular movement about a first axis wherein said angular movement changes said first spaced relationship, said first axis being coincident with said tooling ram axis; and (2) a second adjusting member rotationally coupled to said tooling ram and arranged for angular movement about a second axis perpendicular to said first axis wherein said angular movement changes said second spaced relationship.

* * * * *